US010064776B2

(12) United States Patent
Zhang et al.

(10) Patent No.: US 10,064,776 B2
(45) Date of Patent: Sep. 4, 2018

(54) ORTHOPEDIC HOSPITAL BED AND SURGICAL TABLE WITH THE FUNCTIONS OF TRACTION AND REDUCTION

(71) Applicant: Yingze Zhang, Shijiazhuang, Hebei Province (CN)

(72) Inventors: Yingze Zhang, Shijiazhuang (CN); Wei Chen, Shijiazhuang (CN); Juan Wang, Shijiazhuang (CN); Qi Zhang, Shijiazhuang (CN)

(73) Assignee: Yingze Zhang, Shijiazhuang, Hebei (CN)

( * ) Notice: Subject to any disclaimer, the term of this patent is extended or adjusted under 35 U.S.C. 154(b) by 279 days.

(21) Appl. No.: 14/893,974

(22) PCT Filed: Feb. 16, 2015

(86) PCT No.: PCT/CN2015/073157
§ 371 (c)(1),
(2) Date: Nov. 25, 2015

(87) PCT Pub. No.: WO2015/120817
PCT Pub. Date: Aug. 20, 2015

(65) Prior Publication Data

US 2016/0106610 A1 Apr. 21, 2016

(30) Foreign Application Priority Data

Feb. 17, 2014 (CN) ..... 2014 1 0052867

(51) Int. Cl.
*A61G 13/00* (2006.01)
*A61G 13/10* (2006.01)
(Continued)

(52) U.S. Cl.
CPC ..... *A61G 13/0036* (2013.01); *A61G 7/075* (2013.01); *A61G 7/1057* (2013.01); *A61G 13/101* (2013.01); *A61G 13/1205* (2013.01)

(58) Field of Classification Search
CPC .... A61G 13/00; A61G 13/0036; A61G 13/10; A61G 13/101; A61G 13/1205;
(Continued)

(56) References Cited

U.S. PATENT DOCUMENTS 1,699,026 A * 1/1929 Schumacher ..... A61G 7/00 5/200.1
1,747,799 A * 2/1930 Straus ..... A61B 17/02 600/228
(Continued)

FOREIGN PATENT DOCUMENTS

CN 2208847 Y 10/1995
CN 101785735 A 7/2010
(Continued)

OTHER PUBLICATIONS

International Search Report for International Application No. PCT/CN2015/073157, dated Feb. 16, 2015, with English translation.
(Continued)

*Primary Examiner* — Robert G Santos
*Assistant Examiner* — David R Hare
(74) *Attorney, Agent, or Firm* — Yunling Ren

(57) ABSTRACT

Disclosed is an orthopedics hospital bed and surgical table with the functions of traction and reduction comprising a bedstead, and at least one traction holder, wherein, each of the traction holder includes two traction pillars and a traction beam detachably mounted on top ends of the two traction pillars; a sliding rail is provided at each of the two sides of the bedstead and extends in a direction of a length of the bedstead; lower ends of the two traction pillars of each
(Continued)

traction holder are slidably mounted in the two sliding rails respectively, and connected into the sliding rail through a rotate shaft or a hinge; the traction pillars are locked forwardly at set-up position, and the traction beam is configured to connect to a traction device.

15 Claims, 5 Drawing Sheets

(51) Int. Cl.
*A61G 7/10* (2006.01)
*A61G 7/075* (2006.01)
*A61G 13/12* (2006.01)

(58) Field of Classification Search
CPC ..... A61G 13/128; A61G 13/1285; A61G 7/0501; A61G 7/065; A61G 7/075; A61G 7/1042; A61G 7/1049; A61G 7/1057
See application file for complete search history.

(56) References Cited

U.S. PATENT DOCUMENTS 1,955,017 A * 4/1934 Rankin ..... A61G 13/0036 602/39
1,964,930 A * 7/1934 Siebrandt ..... A61G 7/075 602/33
2,050,183 A * 8/1936 Keller ..... A61G 7/1019 242/535
2,067,891 A * 1/1937 Comper ..... A61G 13/12 27/21.1
2,373,456 A * 4/1945 Chapman ..... A61F 5/04 248/278.1
2,586,488 A * 2/1952 Smith ..... A61B 17/0293 248/201
3,572,326 A * 3/1971 Jensen ..... A61B 17/0293 600/233
3,850,165 A * 11/1974 Throner ..... A61F 5/04 5/84.1
4,355,631 A * 10/1982 Levahn ..... A61B 17/0293 600/230
4,653,482 A * 3/1987 Kurland ..... A61G 13/12 5/601
4,886,258 A * 12/1989 Scott ..... A61G 13/12 5/624
4,926,849 A * 5/1990 Downey ..... A61B 17/0206 600/219
4,953,540 A * 9/1990 Ray ..... A61B 17/0293 600/233
5,025,802 A * 6/1991 Laico ..... A61G 13/12 128/875
5,280,427 A * 1/1994 Magnusson ..... A61L 390/11 600/407
5,518,485 A * 5/1996 Zislis ..... A63B 23/1245 482/131
5,823,976 A * 10/1998 Cain ..... A63B 23/12 248/284.1
6,589,254 B2 * 7/2003 Fontenot ..... A61B 90/17 600/231
6,941,951 B2 * 9/2005 Hubert ..... A61G 13/12 128/845
7,166,113 B2 * 1/2007 Arambula ..... A61B 17/1757 600/417
7,559,102 B1 7/2009 Benzo et al.
7,857,779 B2 * 12/2010 Gondringer ..... A61F 5/04 128/878
8,510,882 B2 * 8/2013 Campagna ..... A61B 6/0421 128/878
2007/0143925 A1 * 6/2007 Paul ..... A61G 13/12 5/624

FOREIGN PATENT DOCUMENTS

CN 101803982 A 8/2010
CN 201664361 U 12/2010
CN 103767845 A 5/2014
CN 203693934 U 7/2014
JP 2000279453 A 10/2000

OTHER PUBLICATIONS

The 1st Office Action issued in the counterpart CN application No. 201410052867.1, dated Jun. 17, 2014, by the SIPO.

* cited by examiner

ORTHOPEDIC HOSPITAL BED AND SURGICAL TABLE WITH THE FUNCTIONS OF TRACTION AND REDUCTION

CROSS REFERENCE TO RELATED APPLICATIONS

The present application is based upon and claims priority to Chinese Patent Application No. 201410052867.1, filed Feb. 17, 2014, the entire contents of which are incorporated herein by reference.

TECHNICAL FIELD

The present disclosure relates to a field of medical apparatus, particularly, relates to an orthopedics hospital bed and surgical table with the functions of traction and reduction being capable of performing traction and reduction.

BACKGROUND

With the increase of accidents in traffic and construction industry, and natural disasters such as earth quake, the accident rate of fracture is raising. With the heavily growth of aging in the world, more and more old people suffer from fracture caused by lower-energy damage such as osteoporosis, reduced bone mass, and falling down. Usually, after being wounded, it should take some days before operation to stabilize vital signs, take preoperative exam, treat internal medicine disease etc. For patient with serious injury or associated with internal medicine disease, it will take more time for diagnosis and treatment before operation.

During orthopedics treatment, traction and reduction are required for many patients with fracture, which is crucial to preoperative preparation and postoperative rehabilitation. It is necessary to maintain a certain time during traction and reduction so as to reach the effect thereof, therefore, for the patient, it should take long time to be treated orthopedics operation in bed. Currently, both hospital bed and surgical table used in orthopedics are common bed without traction and reduction functions, therefore, during operation and postoperative rehabilitation period, it requires to install a traction device on the common bed, which may result in inconvenience when installment, and malfunction such as unstable, inadequate traction. Especially, when transferring a patient from a surgical table to a hospital bed after operation, the traction device should also be transferred under traction condition, which is very inconvenient and difficult, and the hurt body of the patient is inevitable to be moved, which results in friction between ends at fracture portion, thus sharpening the suffering and degrading the effect of treatment.

The foresaid information as disclosed in the background part only serves to enhance understanding of the background of the disclosure, thereby it may not contain ordinary skill information that has been well known.

SUMMARY

The technical problem to be solved by the present disclosure is to provide an orthopedics hospital bed and surgical table with the functions of traction and reduction, which is facilitated to perform traction and reduction during operation for a patient, and may be used as a common hospital bed after operation, thus providing great convenience for orthopedic operation and treatment requiring traction and reduction.

Additional aspects and advantages of the disclosure will be in part set forth in the description below, and in part will become obvious from the description, or may be learned from practice of the present disclosure.

In one aspect, the present disclosure provides an orthopedics hospital bed with the functions of traction and reduction comprising a bedstead, and at least one traction holder, wherein, each of the traction holder includes two traction pillars and a traction beam detachably mounted on top ends of the two traction pillars; a sliding rail is provided at each of the two sides of the bedstead and extends in a direction of a length of the bedstead; lower ends of the two traction pillars of each traction holder are slidably mounted in the two sliding rails respectively, and connected into the sliding rail through a rotate shaft or a hinge; the traction pillars are locked forwardly at set-up position, and the traction beam is configured to connect to a traction device.

In an embodiment of the present disclosure, a connecting recess is provided vertically downward at the upper end of the traction pillars, and both ends of the traction beam are inserted into the connecting recesses.

In an embodiment of the present disclosure, the sliding rail includes slots having upward openings and provided on the bedrails at both sides of the bedstead; the number of the traction holder is two, which are back and forwards arranged on the slots on the bedrails at both sides.

In an embodiment of the present disclosure, a pulling rod is disposed on the bedstead in longitudinal direction of the bedstead, and the sliding rail comprises slots provided at the bedrails at both sides of the bedstead and a slot provided at the pulling rod; the number of the traction holder is plural, wherein, two traction pillars of at least one of the traction holder are disposed on the slot at bedrail at one side and the slot at the pulling rod respectively; and two traction pillars of at least one of the traction holder are disposed on the slot at bedrail at the other side.

In an embodiment of the present disclosure, two rods are disposed on the bedstead in longitudinal direction of the bedstead, and the sliding rail comprises slots provided at the bedrails at both sides of the bedstead and slots provided at the two rods respectively; the number of the traction holder is plural, wherein, two traction pillars of at least one of the traction holder are respectively disposed on the slot at bedrail at one side and the slot at the pulling rod adjacent to the bedrail at one side; and two traction pillars of at least one of the traction holder are disposed on the slot at bedrail at the other side and the slot at the pulling rod adjacent to the bedrail at the other side.

In an embodiment of the present disclosure, a connecting rod is provided between two traction pillars on the slot at the bedrail at the same side.

In an embodiment of the present disclosure, the connecting rod is an assembled structure, which includes a first rod, a second pulling rod, and a bushing; the bushing has internal thread for connecting the first pulling rod and second rod, and external threads of the first pulling rod has a spiral direction opposite to that of the second pulling rod are opposite.

In an embodiment of the present disclosure, the slots at bedrails and pulling rod are through slots which have openings at both ends of the bedrails and pulling rod; the rotate shaft or hinge at lower end of the traction pillar is detachably connected to the bottom surface of the slot; and a plurality of connecting holes are arranged longitudinally at the bottom surface of the slot.

In an embodiment of the present disclosure, the traction pillar includes an inner sleeve and an outer sleeve; outer wall of the inner sleeve slidably contacts to inner wall of the outer sleeve; and the inner sleeve and an outer sleeve are provided with pin holes or spring snaps in a direction of length configured to adjust height.

In an embodiment of the present disclosure, a front part of the bottom surface of the traction pillar is flat, which is pushed against a top surface of the base of the rotate shaft or hinge in case that the traction pillar is set up, such that the traction pillar is locked for preventing being tilted forwards; and rear part of the bottom surface of the traction pillar is arc surface, which permits the traction pillar to be rotated and tilted backward.

In an embodiment of the present disclosure, the traction beam is an assembled structure, a middle part of the traction beam rotatably connects to both end parts of the traction beam and is provided with connecting holes for connecting to the traction device.

In an embodiment of the present disclosure, legs of the bedstead are provided with wheels.

In another aspect, the orthopedics hospital bed with the functions of traction and reduction is used as a surgical table.

According to the above technical solutions, the orthopedics hospital bed with the functions of traction and reduction has positive effects as follow:

The present disclosure provides the orthopedics hospital bed with the functions of traction and reduction, wherein, the traction holder is mounted on the sliding rails of the bedstead, which may be set up and laid down. In case that the traction holder is set up, the traction holder could cooperate with the traction devices, such as traction bow, to perform traction and reduction; In case that the traction holder is laid down, the orthopedics hospital bed becomes a common hospital bed. Therefore, the cost of treatment could be reduced greatly. In one embodiment, two traction holders are disposed at both sides of the bedstead, which could be selectively used for corresponding limbs of the patient. The back and forwards position and height of the traction holder could be adjusted so as to perform a better traction effect. In one embodiment, the slot at bedrails may be designed as through slot so as to act as a sliding rail. The traction pillar of the traction holder is detachably connected to the bottom surface of the slot. When a patient need to be transferred from one bed to another for performing operation or other reasons, the traction pillar could be slid from the slot of one bed to the identical slot of another bed, while the patient is being kept in traction condition. Accordingly, the patient need not suffer any pain and the traction effect is retained.

The orthopedics hospital bed with the functions of traction and reduction is facilitated to perform treatment of traction and reduction for the patient, which could be used as common hospital bed, traction bed and surgical table. Therefore, it is possible to permit patients to receive all needed treatment on the same bed, which avoids troubles and suffering of changing beds and degrades the traction effect. Meanwhile, for doctors, it is greatly facilitated to perform treatment of traction and reduction.

The above and other features and advantages of the present disclosure will become more apparent from the detailed description of exemplary embodiments thereof with reference to accompany drawings.

Figure 1:
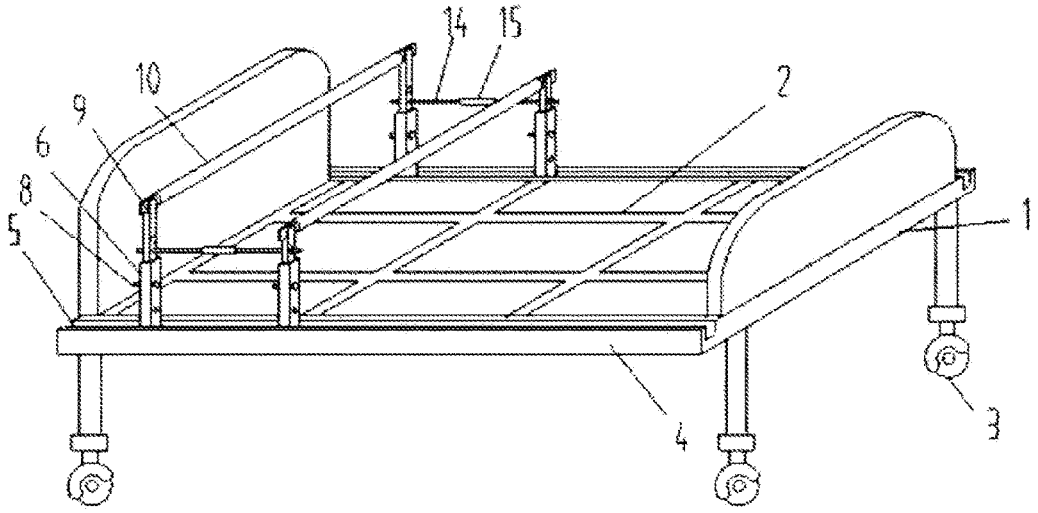
FIG. 1 is a schematic view of the orthopedics hospital bed with the functions of traction and reduction according to an embodiment of the disclosure.

Reference numerals in the above drawings are as follows: bedstead 1, pulling rod 2, wheel 3, bedrail 4, slot 5, traction pillar 6, rotate shaft 7, pin 8, connecting recess 9, traction beam 10, inner sleeve 11, outer sleeve 12, pin 13, connecting rod 14, bushing 15, base of the rotate shaft 16, screw 17, sleeve of the rotate shaft 18.

DETAILED DESCRIPTION

Specific embodiments in this disclosure have been shown by examples in the foregoing drawings and are hereinafter described in detail. The figures and written description are not intended to limit the scope of the inventive concepts in any manner. Rather, they are provided to illustrate the inventive concepts to a person skilled in the art by reference to particular embodiments. The same or similar features employ identical reference numerals, and the detailed description thereof is omitted. The orthopedics hospital bed with the functions of traction and reduction according to the disclosure includes a bedstead 1, a pulling rod 2, a wheel 3 and bedrail 4 etc. The improvement point of the present disclosure is to provide at least one traction holder on the bedstead 1. Each traction holder includes two traction pillars 6 and one traction beam 10 detachably mounted on top ends of the two traction pillars 6. A sliding rail is provided at each of the two sides of the bedstead 1 and extends in the direction along the length of the bedstead 1. Lower ends of two traction pillars 6 of each traction holder are slidably mounted in the two sliding rails respectively, and connected into the sliding rail through a rotate shaft 7 or hinge. The traction pillars 6 may be laid down and set up in the sliding rail. When the traction pillars 6 are set up, they may be locked forwardly, and the traction beam 10 may be connected to a traction device, such as a traction bow.

As shown in FIG. 1, in an embodiment of the orthopedics hospital bed with the functions of traction and reduction, the sliding rail includes slots 5 with an upward opening. Two slots 5 are provided on two bedrails 4 at both sides of the bedstead 1 and extend in a direction of the length of the bedrail 4. The Traction pillars 6 are provided at the slots 5 at the bedrail 4 respectively. At each slot 5, two pillars 6 are arranged back and forwards. At slots 5 on both sides of the bedstead 1, the traction pillars 6 are arranged face to face. A connecting recess 9 is provided vertically downward at the upper end of each traction pillar 6. The traction beam 10 is connected between the connecting recesses 9 on two traction pillar 6 correspondingly located at the bedrail 4 on both sides. Both ends of the traction beam 10 are movably inserted into the connecting recesses 9 respectively. The traction beam 10 plays a function of connecting to the traction device. Bony structures of the lower limbs of a patient, the traction device and the traction beam 10 constitute an integral configuration during traction. The lower limbs of the patient may be raised by using the traction pillars 6, which may avoid the lower limbs of the patient to suffer long-term compression, and complications such as thrombosis. The orthopedics hospital bed with the functions of traction and reduction is especially suitable for old patient.

Figure 2:
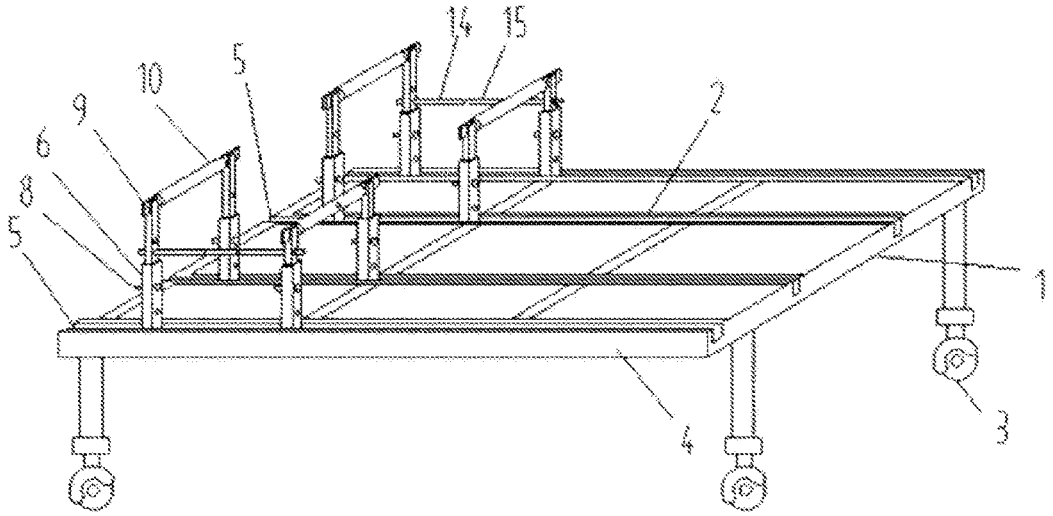
FIG. 2 is a schematic view of the orthopedics hospital bed with the functions of traction and reduction according to another embodiment of the disclosure.

As shown in FIG. 2, in another embodiment of the orthopedics hospital bed with the functions of traction and reduction, the sliding rail includes a plurality of slots 5 with upward openings. These slots 5 are respectively provided on the bedrail 4 at both sides of the bedstead 1 and two longitudinal pulling rods 2 between two bedsteads 1 and extend in a direction of the length of the bedstead 1. Two traction pillars 6 are arranged back and forwards at each slot 5. The traction pillars 6 in the two slots 5 at the rods 2 and the traction pillars 6 in the two slots 5 at the bedrails 4 at both sides constitute two independent traction holders respectively. The traction beam 10 is mounted on top end of each independent traction holder. The above structure provides advantageous as follows: the two traction holders at both sides could be used respectively, that is, if the right limbs of the patient needs traction, the traction holder at right side could be used, and the traction holder at left side could be laid down, such that the space occupied by the traction device may be reduced. The traction holder at left side could be used similarly.

Figure 3:
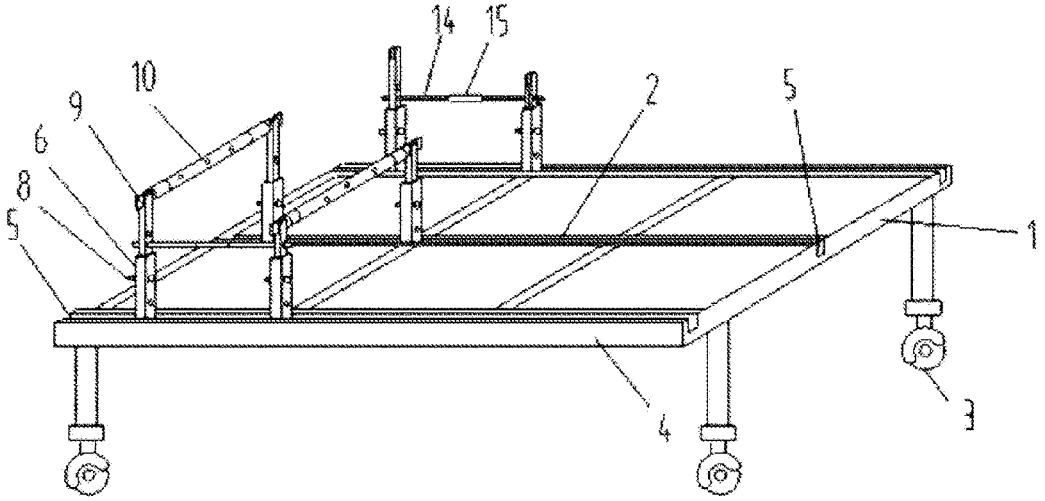
FIG. 3 is a schematic view of the orthopedics hospital bed with the functions of traction and reduction according to a further embodiment of the disclosure.

As shown in FIG. 3, in a further embodiment of the orthopedics hospital bed with the functions of traction and reduction. The slot 5 is provided at one pulling rod 2 instead of two rods 2. Two traction pillars 6 are mounted at the slot 5 of the pulling rod 2, which could combine with the traction pillars 6 at the bedrail 4 at both sides to constitute two independent traction holders respectively. Alternatively, two traction pillars 6 of one traction holder could be mounted at the same slot 5 at the bedrail 4 at one side. The above structure is simple, and the traction beam 10 could be selectively connected to the traction pillars 6 at both sides according to the need for traction of corresponding limbs of the patient.

Figure 4:
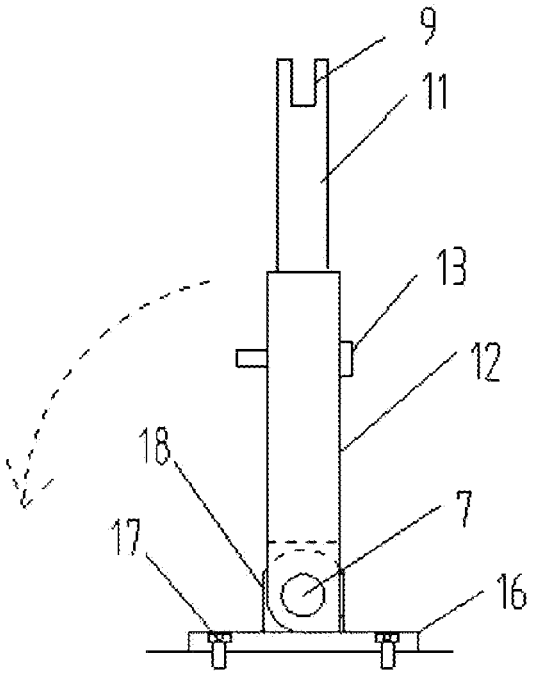
FIG. 4 is a schematic view of a traction pillar of the disclosure.
Figure 5:
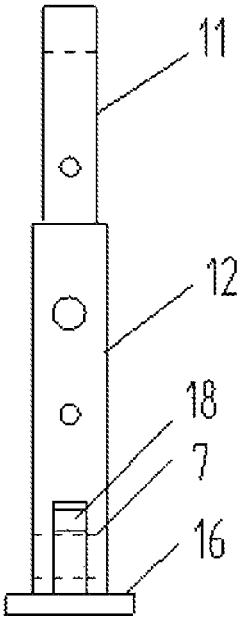
FIG. 5 is a side view of the FIG. 4.

As shown in FIGS. 4 and 5, the traction pillars 6 connect to the slots 5 of the bedrail 4 at each side and pulling rod 2 through the rotate shaft 7 or hinge at lower ends. The traction pillars 6 may be laid down and set up along the slot 5. When the traction pillars 6 are set up, they may be locked forwardly. The locking structure is that: a front part of the bottom surface of the traction pillar 6 is flat, which could be pushed against a top surface of the base of the rotate shaft or hinge when the traction pillar 6 is set up, such that the traction pillar 6 at set-up position could not be tilted forward so as to be drawn forward to traction; the rear part of the bottom surface of the traction pillar 6 is arc surface, which ensures the traction pillar 6 could be rotated backward so as to be laid down backward along the slot 5. A plurality of connecting holes are arranged longitudinally at bottom surface of the slot 5, such that the position of shaft 7 or hinge could be adjusted back and forwards, which facilitates to perform traction for various patients.

As shown in FIGS. 4 and 5, the height of the traction pillar 6 could be adjusted to suit various traction demands. The traction pillar 6 includes an inner sleeve 11 and an outer sleeve 12 sleeved outside the inner sleeve 11. The outer sleeve 12 is movable up-and-down relative to the inner sleeve 11. A plurality of pin holes are arranged longitudinally at the inner sleeve 11 and outer sleeve 12 respectively, in which the pin 13 is inserted so as to adjust the height of the traction pillar 6. Alternatively, a spring snap may be provided between the inner sleeve 11 and the outer sleeve 12 to achieve the height adjustment.

The inner sleeve 11 and the outer sleeve 12 of the traction pillar 6 may be square as shown in the drawings or circular.

As shown in FIGS. 1, 2 and 3, in order to improve stability of traction, a connecting rod 14 may be provided between two traction pillars 6 arranged back and forwards. Both ends of the connecting rod 14 connect to the two traction pillars 6 respectively. In one embodiment, the connecting rod 14 is an assembled structure, which includes a first rod, a second pulling rod and a bushing 15. The bushing 15 has internal thread for connecting the first pulling rod and second rod. External thread of the first pulling rod has a spiral direction opposite to that of the second pulling rod, such that if the length of the connecting rod 14 is required to be adjusted, both ends of the connecting rod 14 could be elongated or shortened simultaneously by rotating the bushing 15. Another important function of the connecting rod 14 is to constitute the traction pillars 6 to be an integral structure, which provides great help to integrally move the traction pillars 6 when changing beds.

As shown in FIGS. 4 and 5, in order to keep traction condition during changing beds caused by performing operation or other reasons, the slot 5 at bedrails 4 and rods 2 may be designed as through slot so as to act as a sliding rail. The slot 5 has openings at both ends of the bedrails 4 and rods 2. Meanwhile, the rotate shaft 7 or hinge at lower ends of the traction pillar 6 is detachably connected to the bottom surface of the slot 5. As shown in FIG. 4, a sleeve of the rotate shaft 18 is disposed at the base of the rotate shaft 16, through which a middle part of the rotate shaft 7 is passed, and both ends of the rotate shaft 7 are passed through holes of the rotate shaft at lower end of the traction pillar 6. The base of the rotate shaft 16 connects to the slot 5 via a screw 17. If requiring to move the traction pillar 6, loosening the screw 17 at the base of the rotate shaft 16, and sliding the traction pillar 6 along the slot 5 to another hospital bed having an identical slot 5. Accordingly, the patient need not to suffer any pain and the traction effect is retained.

As shown in FIGS. 1, 2 and 3, both ends of the traction beam 10 connects to the upper ends of the traction pillars 6 via recesses. A middle part of the traction beam 10 rotatably connects to both end parts of the traction beam 10 respectively. The middle part of the traction beam 10 is provided with connecting holes for connecting to the traction device. By the above structure, during performing traction, the middle part of the traction beam 10 is rotatable for adjusting angle of the traction beam 10, therefore the connection between the traction beam 10 and the traction device, such as a traction bow, is more suitable for actual traction requirement, and a better traction effect may be obtained.

The concept of the disclosure is providing the traction holder on the bedstead for traction and reduction. Besides to the embodiments described above, many other embodiments are feasible, therefore, the above embodiments are not intended to limit the protection scope of the present disclosure. All modifications, equivalent improvements made within the spirit and principles of the present disclosure shall fall within the protection scope of the present disclosure.

INDUSTRIAL APPLICABILITY

The present disclosure provides the orthopedics hospital bed with the functions of traction and reduction, wherein, the traction holder is mounted on the sliding rail of the bedstead, which may be set up and laid down. In case of setting up, the traction holder could cooperate with the traction devices, such as traction bow, to perform traction and reduction; In case that the traction holder is laid down, orthopedics hospital bed becomes a common hospital bed. Therefore, the cost of treatment could be reduced greatly.

Exemplary embodiments have been specifically shown and described as above. It is to be understood that both the foregoing general description are exemplary and explanatory only and are not restrictive of the invention. It will be appreciated the aforesaid embodiments may be modified and portions of the technical features therein may be equally changed, which does not depart from the spirit or principle. All suitable modifications and equivalent which come within the spirit and scope of the appended claims are intended to fall within the scope of the disclosure.

What is claimed is:

1. An orthopedic hospital bed with functions of traction and reduction comprising a bedstead, the bedstead is provided with bedrails at both sides, wherein, further comprising:

at least one traction holder, wherein, each of the traction holder includes two traction pillars and a traction beam detachably mounted on top ends of the two traction pillars; a sliding rail is provided at each of the two sides of the bedstead and extends in a direction of a length of the bedstead; lower ends of the two traction pillars of each traction holder are slidably mounted in the two sliding rails respectively, and connect into the sliding rail through a rotate shaft or a hinge; the traction pillars are locked forwardly at set-up position, and the traction beam is configured to connect to a traction device, wherein, a pulling rod is disposed on the bedstead in longitudinal direction of the bedstead, and the sliding rail comprises slots provided at the bedrails at both sides of the bedstead and a slot provided at the pulling rod; the orthopedic hospital bed with the functions of traction and reduction comprising a plurality of traction holders, wherein, two traction pillars of at least one of the traction holder are disposed on the slot at bedrail at one side and the slot at the pulling rod respectively; and two traction pillars of at least one of the traction holder are disposed on the slot at bedrail at the other side.

2. The orthopedic hospital bed with functions of traction and reduction according to claim 1, wherein, a connecting recess is provided vertically downward at the upper end of the traction pillars, and both ends of the traction beam are inserted into the connecting recesses.

3. The orthopedic hospital bed with functions of traction and reduction according to claim 1, wherein the sliding rail includes slots having upward openings and provided on the bedrails; the orthopedic hospital bed with the functions of traction and reduction comprising two traction holders, which are back and forwards arranged on the slots on the bedrails at both sides.

4. The orthopedic hospital bed with functions of traction and reduction according to claim 1, wherein, two rods are disposed on the bedstead in longitudinal direction of the bedstead, and the sliding rail comprises slots provided at the bedrails at both sides of the bedstead and slots provided at the two rods respectively; the orthopedic hospital bed with the functions of traction and reduction comprising a plurality of traction holders, wherein, two traction pillars of at least one of the traction holder are respectively disposed on the slot at bedrail at one side and the slot at the pulling rod adjacent to the bedrail at one side; and two traction pillars of at least one of the traction holder are disposed on the slot at bedrail at the other side and the slot at the pulling rod adjacent to the bedrail at the other side.

5. The orthopedic hospital bed with functions of traction and reduction according to claim 3, wherein, a connecting rod is provided between two traction pillars on the slot at the bedrail at the same side.

6. The orthopedic hospital bed with functions of traction and reduction according to claim 3, wherein, a connecting rod is provided between two traction pillars on the slot at the bedrail at the same side.

7. The orthopedic hospital bed with functions of traction and reduction according to claim 4, wherein, a connecting rod is provided between two traction pillars on the slot at the bedrail at the same side.

8. The orthopedic hospital bed with functions of traction and reduction according to claim 5, wherein, the connecting rod is an assembled structure, which includes a first rod, a second rod, and a bushing; the bushing has internal thread for connecting the first rod and second rod, and external threads of the first rod has a spiral direction opposite to that of the second rod.

9. The orthopedic hospital bed with functions of traction and reduction according to claim 3, characterized in that the slots at bedrails and pulling rod are through slots which have openings at both ends of the bedrails and pulling rod; the rotate shaft or hinge at lower end of the traction pillar is detachably connected to the bottom surface of the slot; and a plurality of connecting holes are arranged longitudinally at bottom surface of the slot.

10. The orthopedic hospital bed with functions of traction and reduction according to claim 4, characterized in that the slots at bedrails and pulling rod are through slots which have openings at both ends of the bedrails and pulling rod; the rotate shaft or hinge at lower end of the traction pillar is detachably connected to the bottom surface of the slot; and a plurality of connecting holes are arranged longitudinally at bottom surface of the slot.

11. The orthopedic hospital bed with functions of traction and reduction according to claim 1, wherein, the traction pillar includes an inner sleeve and an outer sleeve; outer wall of the inner sleeve slidably contact to inner wall of the outer sleeve; and the inner sleeve and an outer sleeve are provided with pin holes or spring snaps in a direction of length configured to adjust height.

12. The orthopedic hospital bed with functions of traction and reduction according to claim 1, wherein, a front part of a bottom surface of the traction pillar is flat, which is pushed against a top surface of a base of the rotate shaft or hinge in case that the traction pillar is set up, such that the traction pillar is locked for preventing being tilted forwards; and rear part of the bottom surface of the traction pillar is arc surface, which permits the traction pillar to be rotated and tilted backward.

13. The orthopedic hospital bed with functions of traction and reduction according to claim 1, wherein, the traction beam is an assembled structure, a middle part of the traction beam rotatably connects to both end parts of the traction beam and is provided with connecting holes for connecting to the traction device.

14. The orthopedic hospital bed with functions of traction and reduction according to claim 1, wherein, legs of the bedstead are provided with wheels.

15. An orthopedic hospital bed with functions of traction and reduction comprising a bedstead, the bedstead is provided with bedrails at both sides, wherein, further comprising:

at least one traction holder, wherein, each of the traction holder includes two traction pillars and a traction beam detachably mounted on top ends of the two traction pillars; a sliding rail is provided at each of the two sides of the bedstead and extends in a direction of a length of the bedstead; lower ends of the two traction pillars of each traction holder are slidably mounted in the two sliding rails respectively, and connect into the sliding rail through a rotate shaft or a hinge; the traction pillars are locked forwardly at set-up position, and the traction beam is configured to connect to a traction device, wherein, a pulling rod is disposed on the bedstead in longitudinal direction of the bedstead, and the sliding rail comprises slots provided at the bedrails at both sides of the bedstead and a slot provided at the pulling rod; the orthopedic hospital bed with the functions of traction and reduction comprising a plurality of traction holders, wherein, two traction pillars of at least one of the traction holder are disposed on the slot at bedrail at one side and the slot at the pulling rod respectively; and two traction pillars of at least one of the traction holder are disposed on the slot at bedrail at the other side, wherein, the orthopedic hospital bed with functions of traction and reduction is used as a surgical table.

* * * * *